US005287666A

United States Patent [19]

Frascaroli et al.

[11] Patent Number: 5,287,666

[45] Date of Patent: Feb. 22, 1994

[54] OFFICE FURNISHING UNIT FRAMEWORK

[75] Inventors: Francesco Frascaroli; Paolo Consolini, both of Bologna; Carlo Biondi, San Giovanni in Persiceto, all of Italy

[73] Assignee: C.O.M. S. Coop. A.R.L., San Giovanni in Persiceto, Italy

[21] Appl. No.: 703,650

[22] Filed: May 21, 1991

[30] Foreign Application Priority Data

May 21, 1990 [IT] Italy ..... 67365 A/90

[51] Int. Cl.[5] ..... E04B 2/76

[52] U.S. Cl. ..... 52/239; 52/271; 52/653.1; 52/654.1; 52/655.1; 52/656.6; 52/656.9; 52/665; 403/297

[58] Field of Search ..... 52/239, 284, 648, 650, 52/36, 221, 648.1, 650.1, 653.1, 654.1, 655.1, 656.1, 656.6, 656.9, 665, 281, 241, 271, 272, 282, 780, 781; 160/135, 351; 403/391, 389, 387, 297

[56] References Cited

U.S. PATENT DOCUMENTS 2,094,607 10/1937 Kotrbaty ..... 52/281 X
2,101,073 12/1937 Kotrbaty ..... 52/281
4,283,157 8/1981 Kowalski ..... 403/297
4,557,091 12/1985 Aver ..... 52/282
4,993,205 2/1991 Dull et al. ..... 52/584

FOREIGN PATENT DOCUMENTS 0305542 3/1989 European Pat. Off. .
2442479 3/1975 Fed. Rep. of Germany .
2160905 1/1986 United Kingdom .

*Primary Examiner*—Carl D. Friedman
*Assistant Examiner*—Robert J. Canfield
*Attorney, Agent, or Firm*—Sughrue, Mion, Zinn, Macpeak & Seas

[57] ABSTRACT

The structure of an office furnishing system is constituted by a plurality of modular elements which can be interconnected in various possible configurations, the same basic elements being usable to form work stations as well as partition walls and screens, integrated into a harmonious unit. Each modular element includes a framework of upright members and cross members interconnected together. Each upright member and each cross member is formed from two parallel, profiled, metal sections spaced apart and interconnected by in at least two regions by first and second connectors respectively. The first and second connectors have complementary engaging surfaces for quickly connecting the cross members to the upright members.

6 Claims, 12 Drawing Sheets

OFFICE FURNISHING UNIT FRAMEWORK

BACKGROUND OF THE INVENTION

The present invention relates to office furnishing systems. In recent times ever more widespread use has been made in modern offices of partition walls constituted by modular elements which can be assembled in various possible configurations and are used to divide an area into several separate work spaces. The partition walls usually extend from the floor to the ceiling of the area in which they are fitted and may be equipped with auxiliary elements such as bookshelves, suspended fittings or cupboards. The main advantage of the use of such partition walls lies, on the one hand, in the fact that the space available can be partitioned as desired fairly quickly and easily and, on the other hand, in their extreme flexibility in use which means that the furnishing of an area can be modified quickly and easily after its initial fitting-out, or even that elements originally used in one location can be re-used to furnish a different location.

A similar development, parallel to that indicated above, has also taken place in the field of office workstation furnishings (desks, boardroom tables, work surfaces for typists, etc.). In this field, it has also been proposed to use furnishing systems which provide for the assembly of modular elements in various possible configurations so as to fulfil the needs for ease, rapidity and flexibility of assembly.

Finally, still in the field of office furnishing, screens (this term meaning low partition walls which do not extend up to the ceiling) have for some time been used within a work space, for example, for dividing one work station from another. These screens may also be equipped with shelves, suspended fittings, or work surfaces.

Hitherto, separate modular furnishing systems have been proposed for partition walls and for screens and work stations respectively. In some cases, integrated modular systems have also been proposed and provide both partition walls and screens.

SUMMARY OF THE INVENTION

The object of the present invention is to improve the previously-proposed systems by making their assembly easier, quicker and more flexible, as well as to rationalise and simplify the criteria for the manufacture of office furnishing systems and for the storage of their components.

In order to achieve the object specified above, the subject of the present invention is a method for the production of office furnishing systems, characterised in that it comprises the following steps:

a) providing a plurality of upright members of different heights, the plurality including:

upright members of a first, shorter type, suitable for supporting a work surface for a seated person, upright members of a second, taller type, suitable for supporting partition walls, upright members of a third type, provided in one or more intermediate heights, suitable for supporting screens, b) providing a plurality of cross members which can be connected to the top ends of the first type of upright members in order to form the framework of a work surface, or to the second or third types of upright members to form the framework of partition walls and screens, c) providing a plurality of quick-connection members for connecting upright members of any type to cross members, d) selecting a specific plurality of upright members, cross members and connecting members, e) assembling the aforesaid members so as to form the framework of an office furnishing unit with a specific configuration, incorporating partition walls as well as work stations and screens.

By virtue of the production method indicated above, the manufacturer can provide a single modular construction system for the complete furnishing of an office. The design and construction of the system are thus rationalised and simplified. The storage of the components of the system is also simplified since the number and types of components needed to form all the furnishing elements is reduced to a minimum. Finally, the system can be assembled quickly and easily by a single method of assembly which is common to all the components of the system. One of the main advantages of the method specified above consists of the fact that the various furnishing components can be integrated harmoniously with each other with a single aesthetic style. By virtue of the present invention, the user can not only furnish his own office area, but can define its outlines, its volume and its degree of transparency. The speed and flexibility of assembly also enables the space available to be transformed quickly to accord with new working requirements.

A further subject of the present invention is an office furnishing unit produced by the method specified above.

In a preferred embodiment of the furnishing unit of the invention, the first, second and third types of the upright members and the cross members all have identical structures and configurations, except for their lengths. Preferably, the structure of each upright member and of each cross member comprises two parallel, metal profiled sections spaced apart and interconnected by means of at least two connectors in spaced-apart positions.

According to a further characteristic, the connectors of the upright members and the connectors of the cross members have complementary interlocking surfaces to enable the rapid connection of the upright members to the cross members.

A further preferred characteristic consists of the fact that the complementary interlocking surfaces have inclined parts such that a cross member is tensioned by its coupling with a respective upright member to ensure the complete stability of the assembled structure.

BRIEF DESCRIPTION OF THE DRAWINGS

Further characteristics and advantages of the invention will become clear from the description which follows, and from the appended drawings, provided purely by way of non-limiting example, in which.

DETAILED DESCRIPTION OF THE INVENTION

Figure 1:
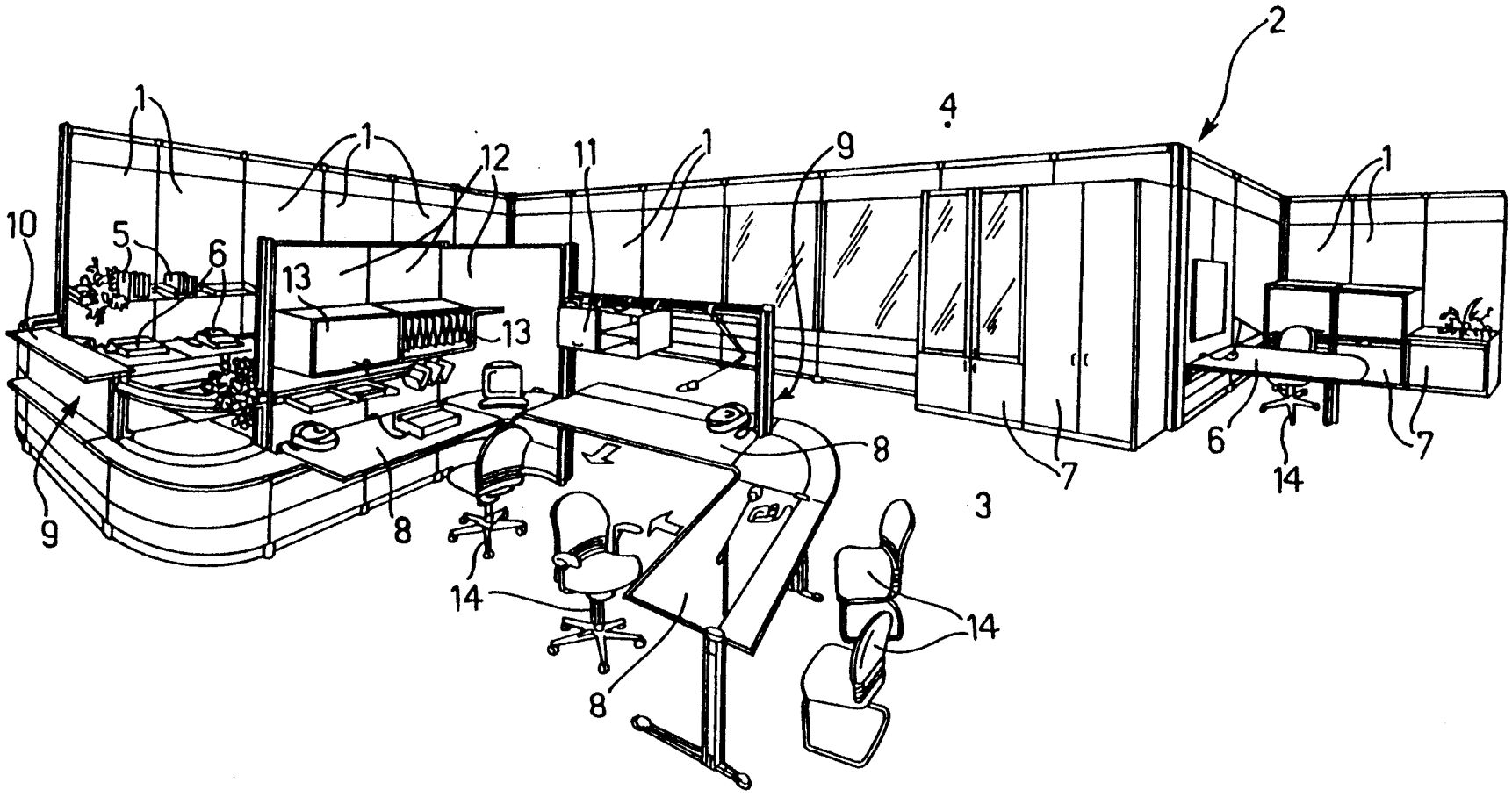
FIGS. 1 and 2 are perspective views showing first and second examples of office furnishing units according to the present invention.

FIG. 1 shows an embodiment of an office furnishing unit which can be produced entirely—except for the chair—by the method of the invention. The furnishing unit of the embodiment illustrated includes a plurality of partition walls 1 which define a continuous wall 2 extending vertically from the floor 3 to the ceiling 4 of an area so as to divide it into two spaces. One of the spaces is not visible in FIG. 1, since it is hidden by the walls 1 whilst the other work space ,which is visible in FIG. 1, is furnished with a plurality of work stations and screens.

In the embodiment shown in FIG. 1, some of the partition walls 1 are equipped with cantilevered shelves 5 as well as with work surfaces 6, also cantilevered, for seated persons. Other partition walls 1 are equipped with fittings and/or cupboards 7.

Work stations 8 for seated persons are also provided. The work stations 8 have associated support structures 9 for raised support surfaces 10 or suspended fittings 11, as well as screens 12 which are lower than the partition walls 1 and are used to separate a first region of work stations 8 from a second region. The screens 12 are equipped—still with reference to the embodiment shown, with suspended fittings 13 and shelves 14. FIG. 1 also shows the chairs 14 which are associated with the various work stations but which do not form part of the furnishing system of the invention.

Figure 2:
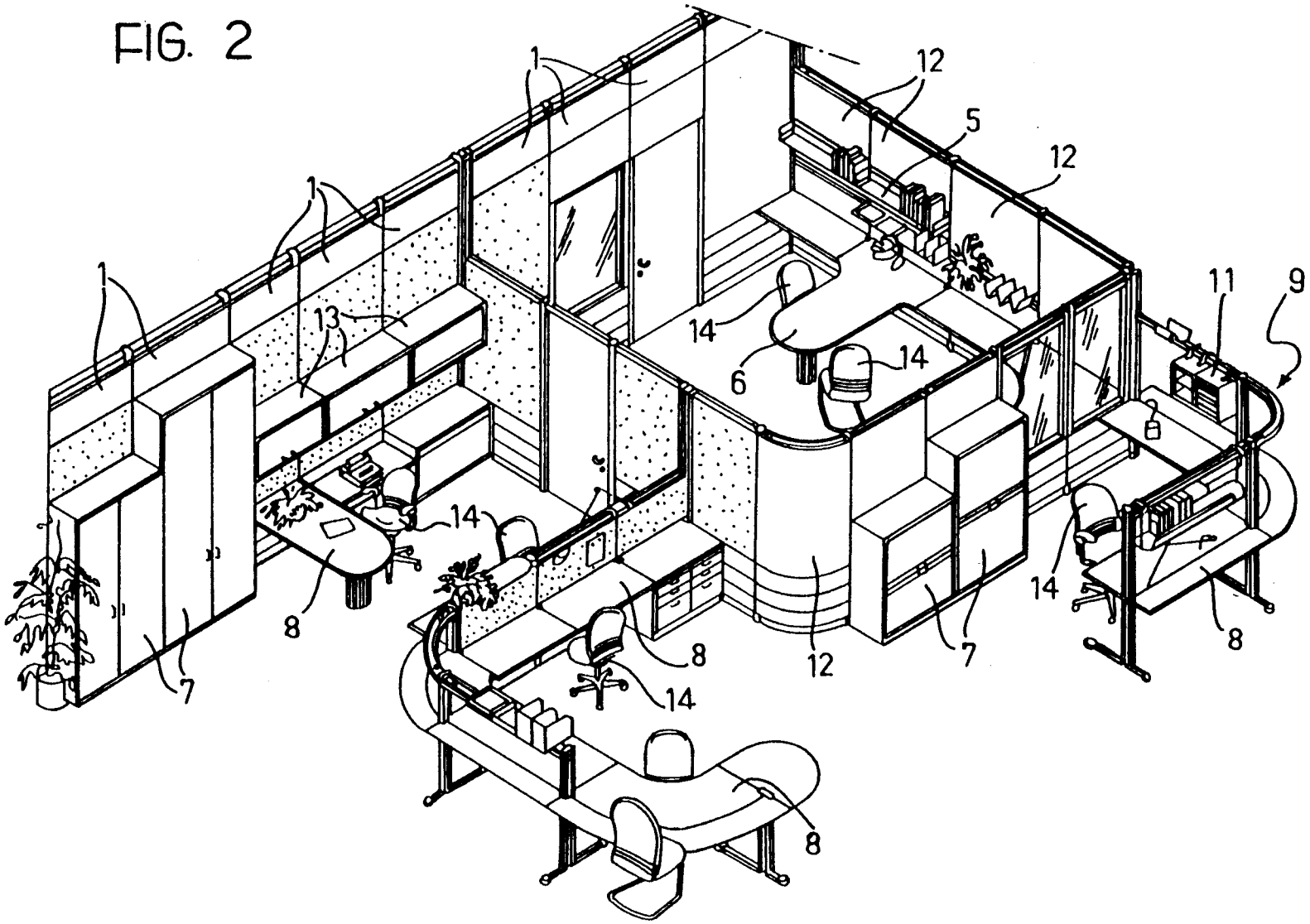

FIG. 2 shows a further embodiment of furnishing unit according to the invention. In this drawing, the parts which correspond to those of FIG. 1 are indicated by the same reference numerals.

In the system according to the invention, the same modular elements are used to form the framework of the partition walls 1, of the screens 12, and of the work stations 8.

Figures 3, 4:
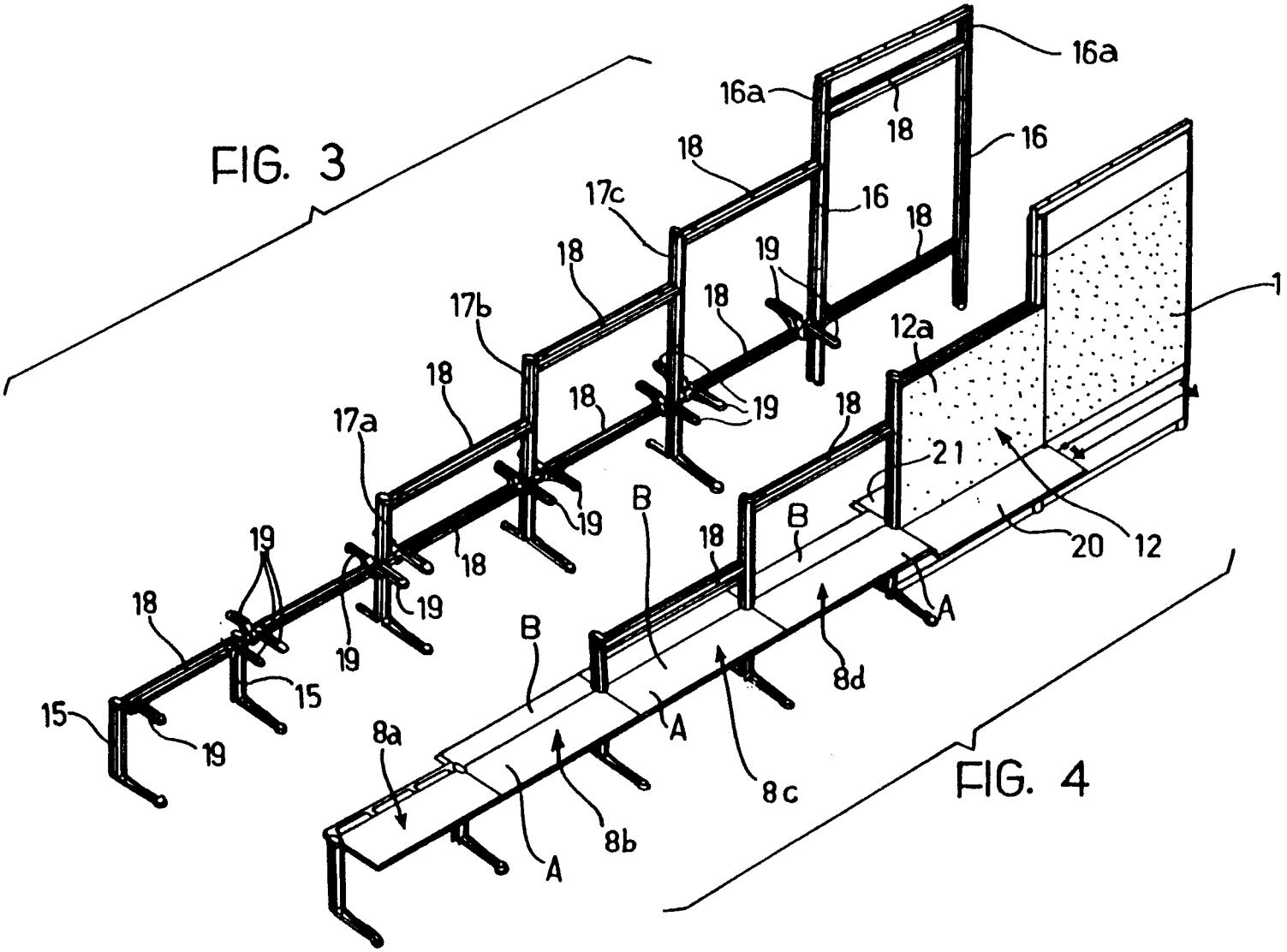
FIG. 3 is a perspective view showing, by way of example, the framework of a further furnishing unit according to the invention.
FIG. 4 is a perspective view of the framework of FIG. 3 completed by further components.

An example of this general criterion of construction is shown in FIGS. 3 and 4.

More specifically, FIG. 3 shows the framework of a structure which, in the finished condition of assembly shown in FIG. 4, comprises a partition wall 1, a screen 12 and five work stations 8*a*, 8*b*, 8*c*, 8*d*, 20 and 21, fitted out in four different configurations. As shown in FIG. 2, the framework of the unit shown in FIG. 4 comprises a network of interconnected upright members and cross members. Basically, the upright members are of three different types. A first type of upright member, indicated 15, is shorter than the other types of upright member and serves to support a work surface for a seated person. A second type of upright member, indicated 16, is taller, and supports the partition wall 1. The upper end of each upright member 16 is constituted by a separate element 16*a* for enabling the overall height of the member 16 to be adapted to the distance between the floor 3 and the ceiling 4. Finally, a third type of upright member is provided with a height intermediate those of the first type of member 15 and the second type of member 16. More precisely, the third type provides, for example, three possible sub-types 17*a*, 17*b*, 17*c*, of different lengths.

The various types of upright member may also be formed by the superposition of several standard modules.

The upright members 15, 16, 17*a*, 17*b*, 17*c* are connected rigidly, by quick connection means which will be described in detail below, to cross members 18 which, in the embodiment illustrated, are of a single standard length.

Still with reference to the embodiment illustrated, the cross members 18 which are associated with the two upright members 16 constitute therewith the framework of the partition wall 1; the cross members 18 associated with the two upright members 17*c*, 16 form parts of the support structure of the screen 12. The cross member 18 associated with the upper end of the upright member 17*b* and the cross member 18 associated with the upper end of the upright member 17*a* are used to support raised bearing surfaces or suspended fittings (not shown in FIG. 4). The rest of the cross members 18 are all aligned horizontally at the height of the upper ends of the upright members 15.

With the exception of the cross member 18 which forms part of the support structure of the partition wall 11, the other aligned cross members 18 are provided with brackets 19 for supporting the surfaces of the work stations 8*a*, 8*b*, 8*c* and 8*d* as well as for work surfaces 20 and 21 associated with the screen 12. The upright members 15, 17*a*, 17 *b* and 17*c* also have support feet at their lower ends. Each of the work stations 8*b*, 8*c* and 8*d* has two co-planar work surfaces A, b in counterpart positions, which can slide on the respective support brackets 19, longitudinally of the brackets, between positions in which they are close together (shown in FIG. 4) and positions in which they are spaced apart to enable the insertion of any screen or partition wall between the two counterpart surfaces A, B. The same is true of the surfaces 20, 21 which are shown spaced apart to allow the screen 12 to be fitted between them.

This screen is constituted by a pair of parallel panels 12*a* (only one of which is visible in FIG. 4) which are fixed to the framework constituted by the upright members and the cross members.

Figure 5:
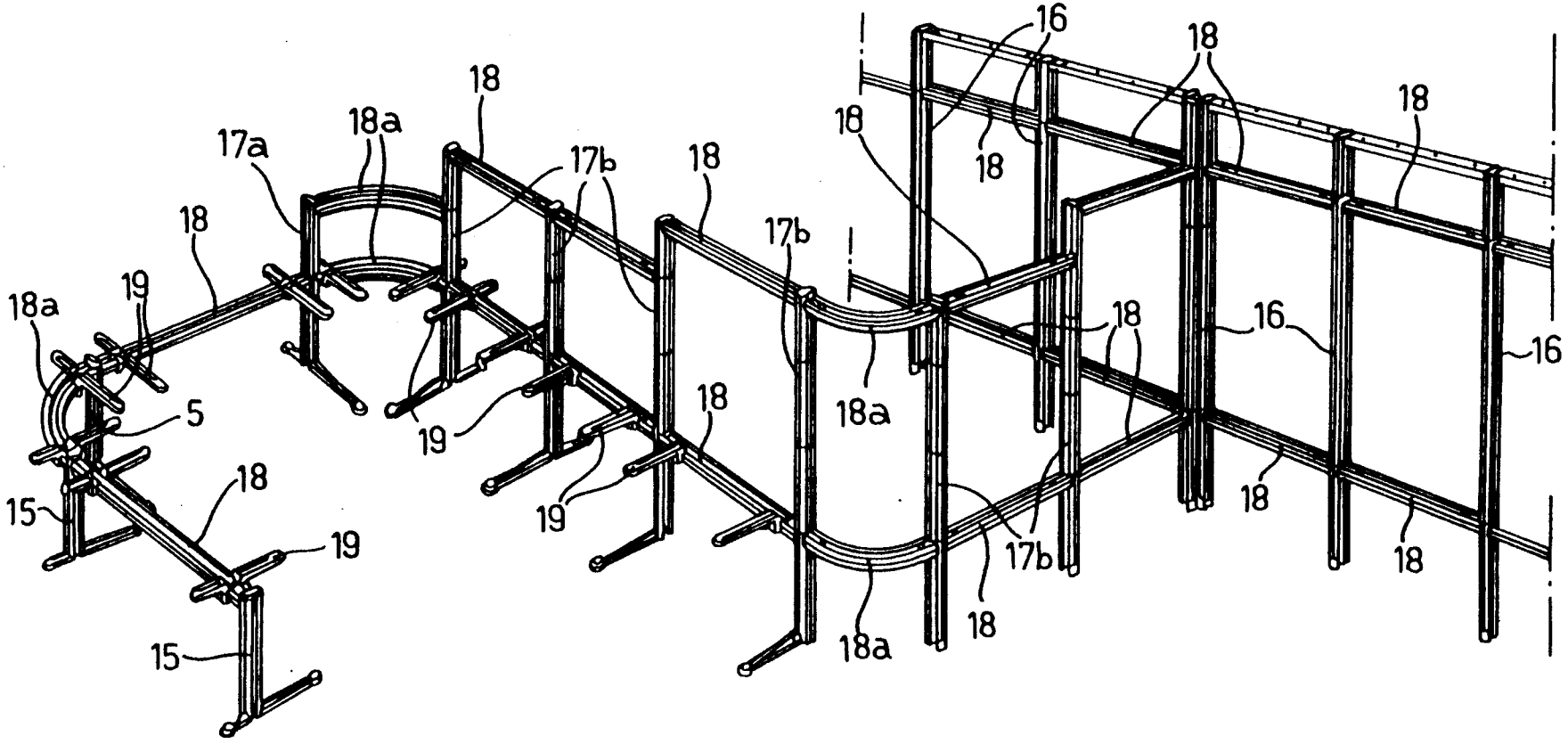
FIGS. 5 and 6 are variants of FIGS. 3 and 4.
Figure 6:
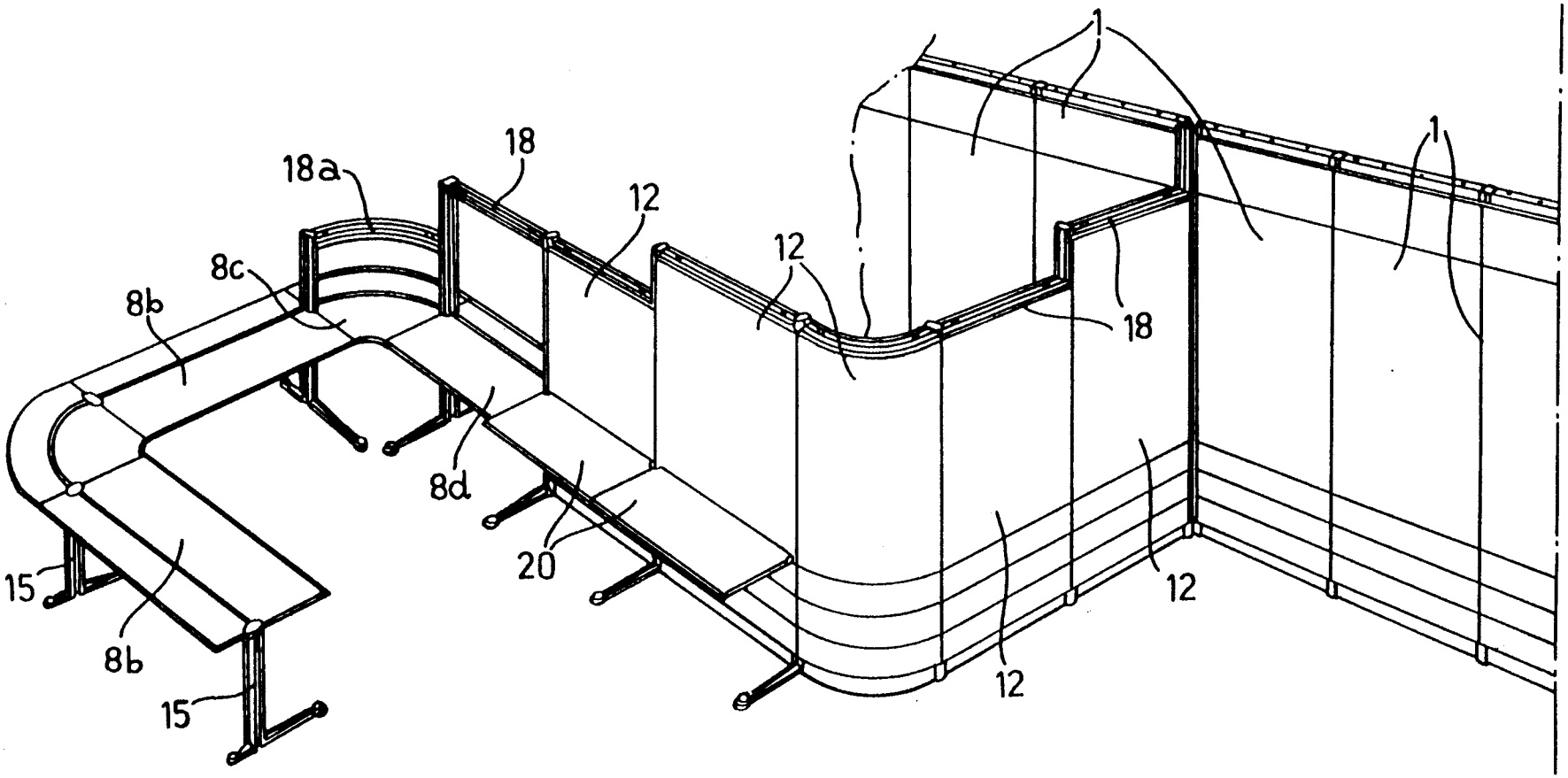

A variant of the solution shown in FIGS. 3 and 4 is shown in FIGS. 5 and 6. In this case, the cross members 18 are interconnected by curved portions 18*a*.

Figure 7:
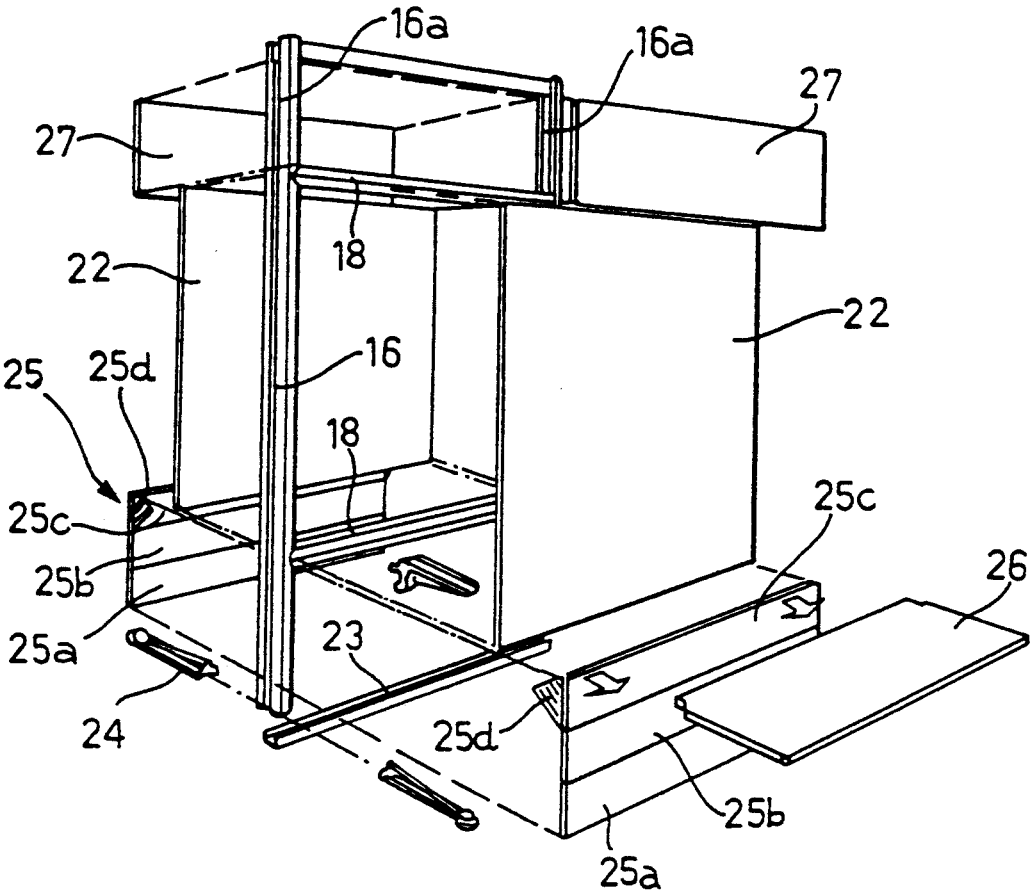
FIG. 7 is an exploded perspective view of a partition wall which forms part of the unit according to the invention.
Figure 8A:
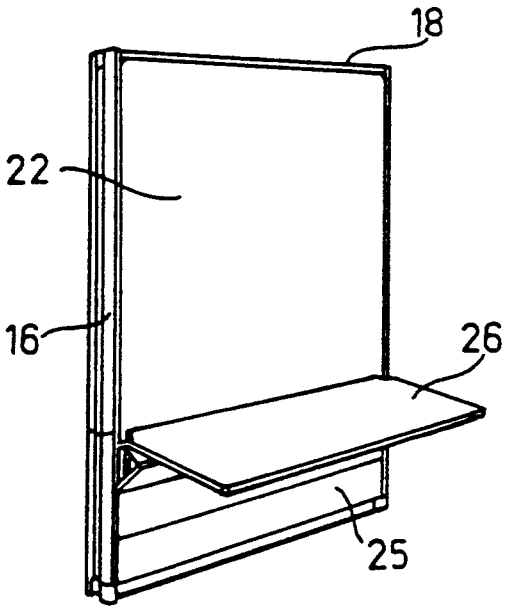
FIGS. 8*a*, 8*b* show two different configurations of partition walls.
Figure 8B:
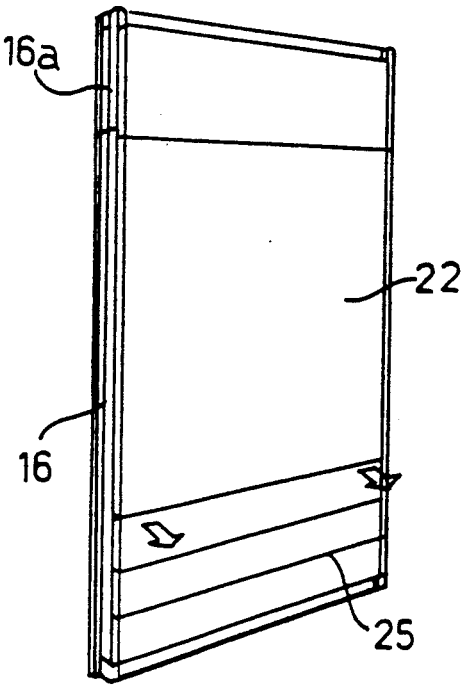

With reference to FIGS. 7, 8A and 8B, a partition wall 1 includes a framework constituted by the two upright members 16 and the two cross members 18 which have been described above. The two additional parts 16a are attached to the upper ends of the two upright members 16.

Two panels 22 are attached to the portion of the framework whose outline is defined by the two upright members 16 and the two cross members 18. The lower ends of the two upright members 16 are interconnected by a channel-shaped cross member 23 of upwardly-facing U section, which supports the entire structure of the partition wall on the floor. As an alternative to the cross member 23, support fleet 24 may be fixed to the lower ends of the two upright members 16. The part of the framework of the partition wall which is below the lower cross member 18 is also covered on opposite sides by two parallel panels 25. In the embodiment illustrated, each of the panels consists of three panels 25a, 25b and 25c arranged edge-to-edge vertically and mutually interconnected. The upper panel 25c is connected to the intermediate panel 25b so that it can pivot about its longitudinal edge adjacent the panel 25b. The panel 25c can thus be pivoted between an upright position, in which it is co-planar with the other two panels 25a and 25b (see FIGS. 7, 8B) and a position in which it is tilted outwardly (FIG. 8A) and leaves free the space needed to fix two brackets 19 (not visible in the drawings) to the lower cross member 18 to support a work surface 26 (FIGS. 8A). The panel 25c has two circular-sector cheeks 25d at its ends to serve as guides for the pivoting of the panel 25c. Alternatively, panel 25 can have a single-piece rigid structure, provided at its top with two tilting lids (not shown) to allow fixing of the two brackets 19 supporting the work surface 26. FIGS. 8A and 8B show a partition wall 1 without the upper extension part but with a work surface 26, and a partition wall 1 with an upper extension part but without a work surface, respectively. Two panels 27 are associated with the two parts 16a of the cross members.

The structures of the upright members 16 and of the cross members 18, as well as of the connecting members which are used for interconnecting cross members and upright members will now be described with reference to FIGS. 9–16 of the appended drawings.

As already indicated above, the structures and configurations of all of the types of upright members 15, 16 and 17 and of the cross members 18 are substantially the same, naturally except for the lengths of these members.

Figure 10:
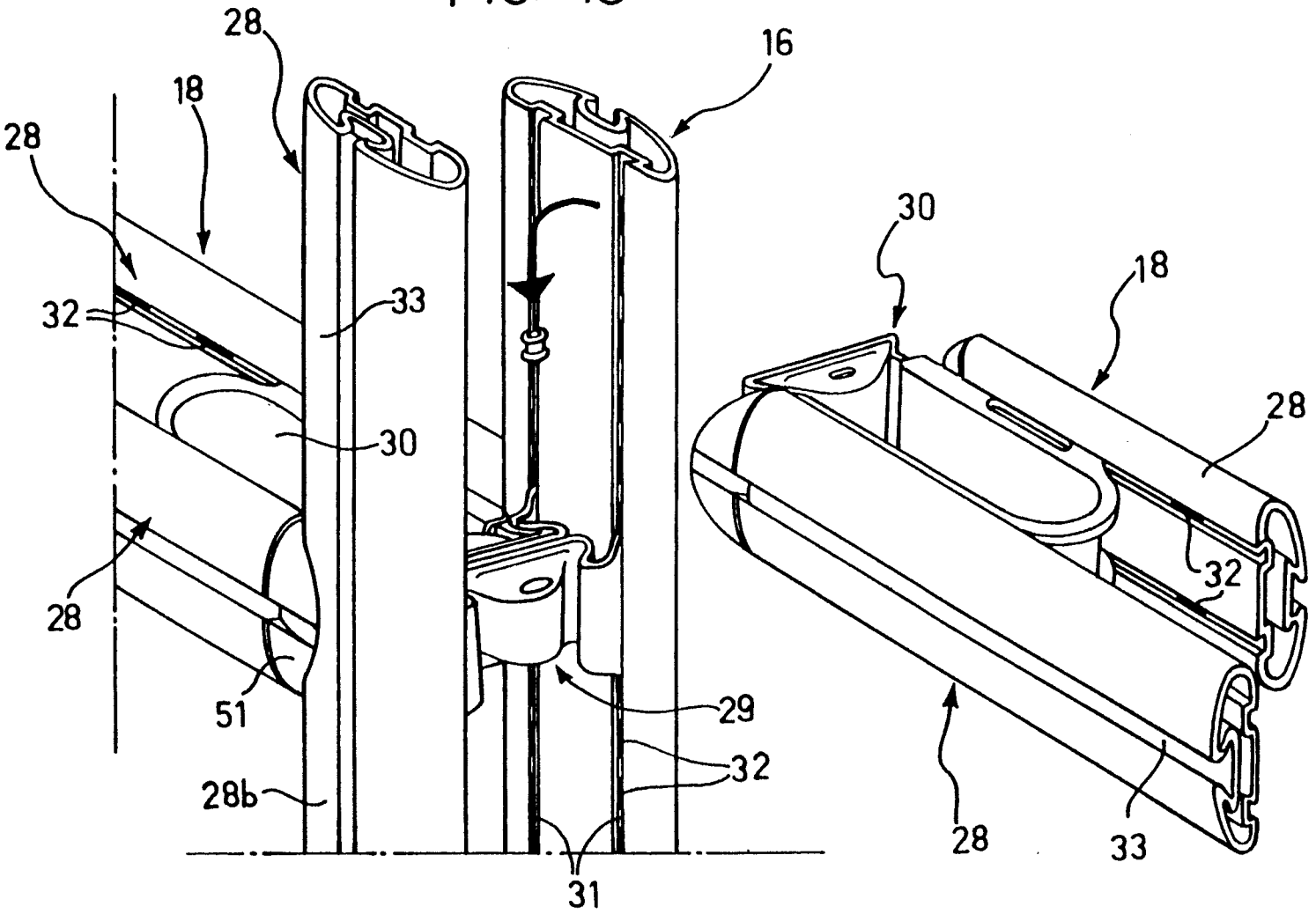
FIG. 10 is a perspective view of the components shown in FIG. 9 in a partially assembled condition.
Figure 13:
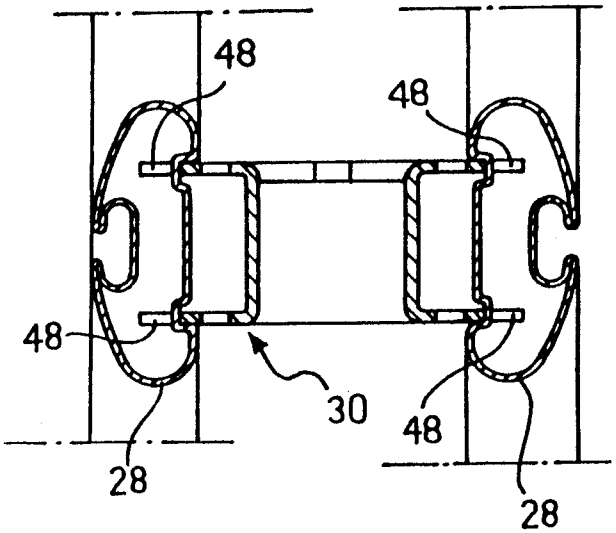
FIG. 13 is a section taken on the line XIII of FIG. 11.
Figure 11:
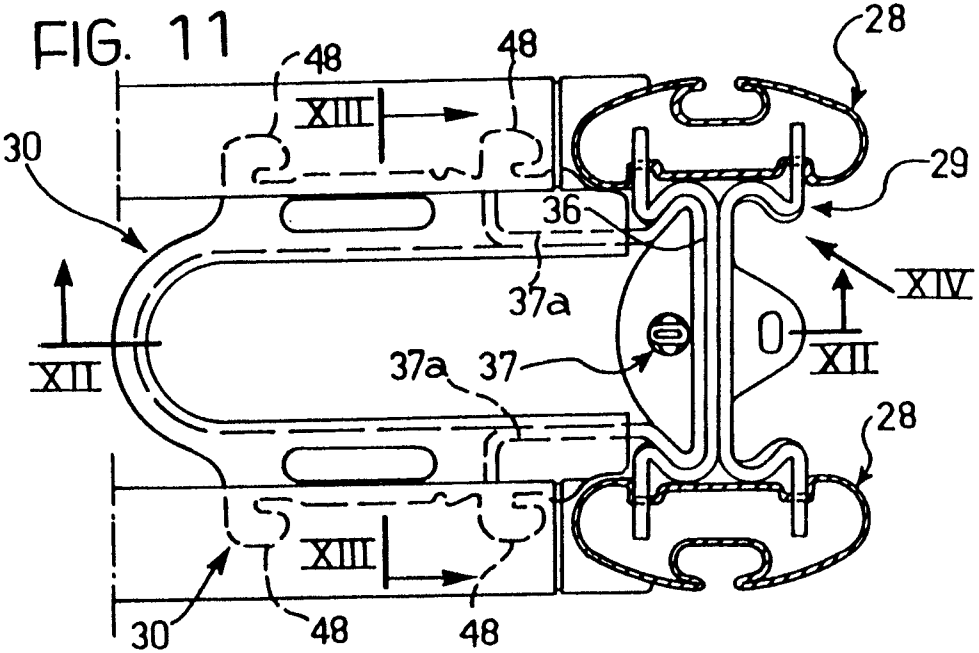
FIG. 11 is a section, taken in a horizontal plane, of the components of FIGS. 9, 10 in the assembled condition.
Figure 12:
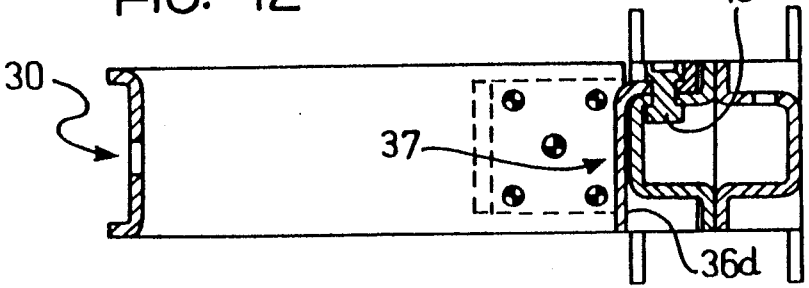
FIG. 12 is a section taken on the line XII of FIG. 11.

With reference in particular to FIG. 10, each upright member (FIG. 10 shows, by way of example, an upright member 16 of the second type described above) comprises two parallel, metal profiled sections 28, spaced apart and interconnected in at least two spaced-apart regions by connectors 29 (only one of these connectors is visible in the drawings).

Each cross member 18 also comprises a pair of parallel profiled sections 28, spaced apart and interconnected in at least two spaced-apart regions by connectors 30. The connectors 29, 30 have complementary interlocking surfaces for the quick connection of an upright member to a cross member.

As can be seen in FIGS. 9, 10 and 11, 13, each of the profiled sections 28 has a substantially eliptical cross-section with one flattened side, whereby each section has one flat face 28a (the flat faces 28a of two sections 28 constituting the same member face each other) and an opposing convex face 28b. The flat face 28a has two spaced-apart longitudinal channels 31, each formed with a series of aligned slots 32 in its base. The face 28b, however, has a single central longitudinal channel 33 of substantially T-shaped cross-section that its slot opening is narrower than its base.

Figure 9:
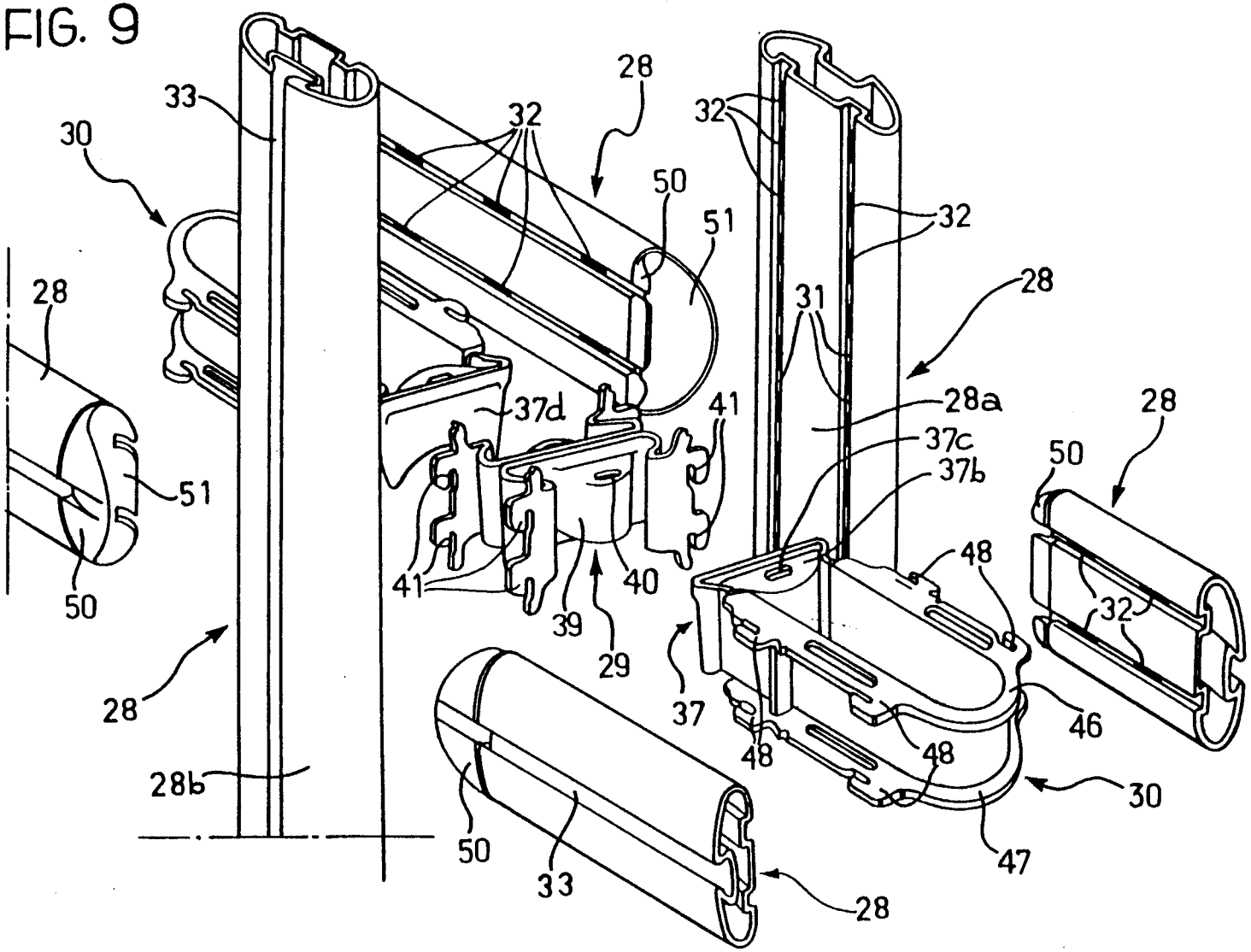
FIG. 9 is an exploded perspective view of the region of a joint connecting an upright member and a cross member forming parts of the unit according to the invention.
Figure 14:
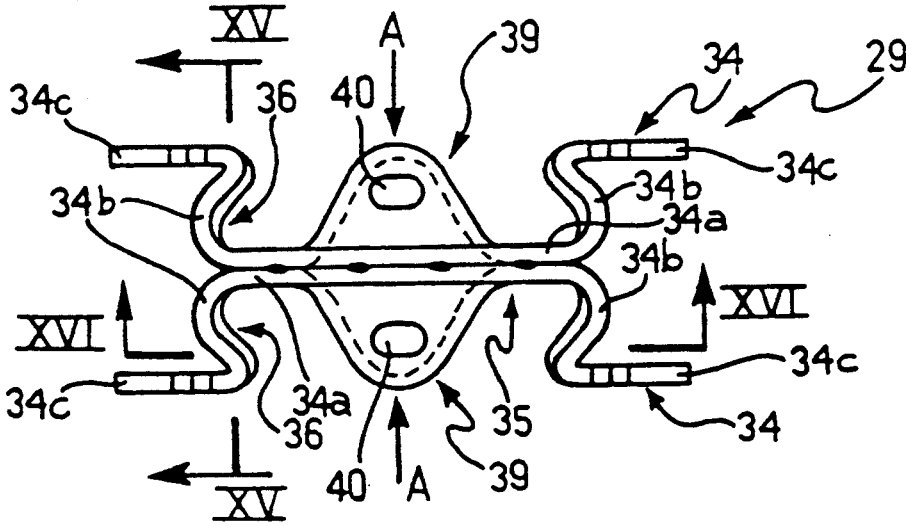
FIG. 14 is a plan view of a component indicated by the arrow XIV in FIG. 11.
Figure 15:
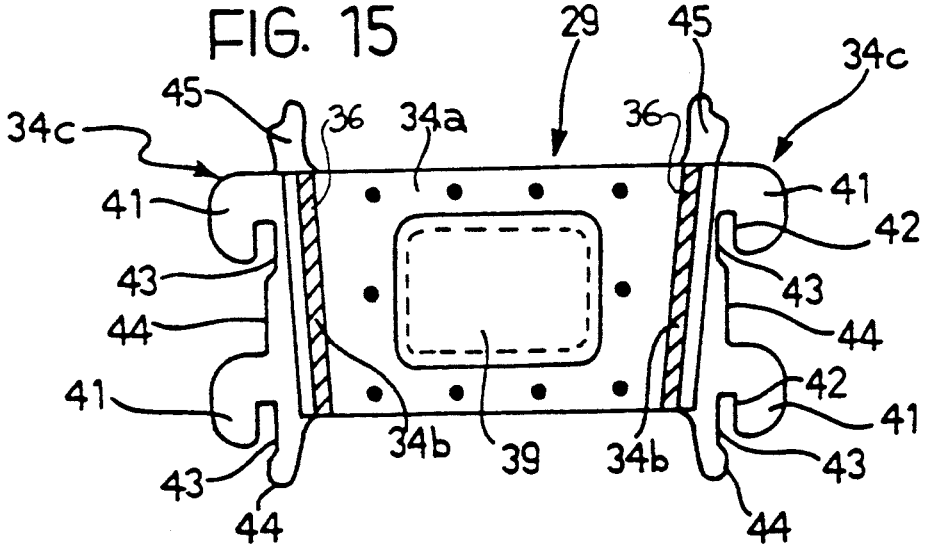
FIG. 15 is a section taken on the line XV of FIG 14.
Figure 16:
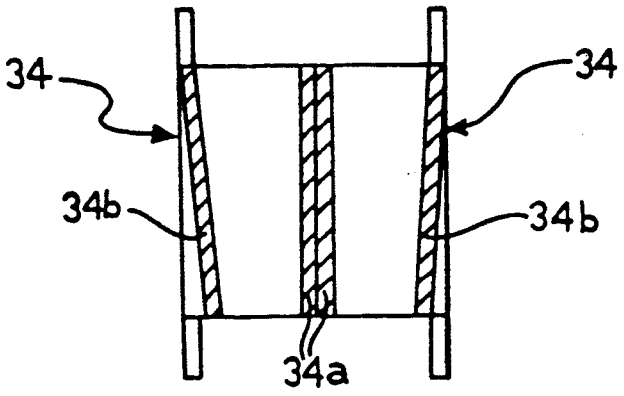
FIG. 16 is a section taken on the line XVI of FIG. 11.

The structure and shape of the connector 29 for interconnecting the profiled sections 28 constituting each upright member can be seen in FIG. 9 and in FIGS. 14–16. Each connector 29 has a generally H-shaped configuration defined by two sheet-metal strips 34 (FIG. 14) each having a substantially C-shaped configuration with outwardly-turned end portions. The flat central portions 34a of the two sheet-metal strips are welded together so as to form the central wall 35 (FIG. 14) of the connector 29. The end arms of each strip 34 comprise two converging portions 34b and two outwardly-turned end parts 34c. The portions 34b are inclined so as also to converge downwardly (with reference to the position of the connector in the assembled condition) to define a V-shaped seat 36 (FIG. 15) for housing a complementary, wedge-shaped member 37 of a connector 30, as will be described in greater detail below. FIGS. 15, 16 show clearly the double inclination of the portions 34b, that is, their inclination in a plane parallel to the part 35 (FIG. 15) and their inclination in a plane perpendicular to that part (FIG. 16). The inclination visible in FIG. 16 means that, when a wedge-shaped member 37 is received in a seat 36, it is pulled in the direction of the arrow A of FIG. 14.

The central part 34a of each of the two strips 34 forming the connector 29 has a projecting portion 39 with a convex front wall (see FIG. 9) and a flat upper wall formed with a slot 40 whose function will be explained below.

Each end part 34c defines a pair of superposed, spaced-apart, downwardly facing tabs for engaging respective slots 32 in the corresponding profiled section 28. In order to ensure the rigid connection of the connector and its two associated sections 28 following the engagement of the tabs 41 in the slots 32, the periphery of each tab 41 has a vertical portion 42 on the inner side of the tab and the periphery of the part 34c below each tab has two offset vertical portions 43, 44 of which the lower portion 44 is nearer to the portion 42. Thus, when the tabs 41 are engaged in the slots 32 in a profiled section 28, the base walls of the slots 32 of the section are caught between the opposing portions 42 and 44, associated with each tab 41. For the same purpose, each part 34c has a projection 45 on its upper edge for engaging the wall of the profiled section 28.

The connector 30 also has a structure constituted by various sheet-metal parts welded together. The body of the connector 30 (FIG. 9) has a substantially U-shaped configuration which is arranged in a horizontal plane in the assembled condition and has a upper and lower flat, parallel, projecting edge portions 46, 47 which define four pairs of tabs 48 with configurations identical to those of the tabs 41 of the connector 29. The tabs 48 are intended to engage corresponding slots 32 in two respective profiled sections 28 constituting a cross member. The two free ends of the U-shaped element are interconnected by the wedge-shaped member 37. This wedge-shaped member is constituted by a U-shaped sheet-metal element with arms 37a (see FIG. 11) placed beside, and welded to, the arms of the main U-shaped body of the connector 30 and a central part with an upper wall 37b (FIGS. 9, 12) which is intended to be superposed on the upper wall of the corresponding projection 39 of a connector 29 and which has a slot 37c for matching the slot 40 in the connector 29.

The wedge-shaped member 37 also has two downwardly-converging side walls and a frontal wall 37*d* (FIGS. 9, 12) which is intended to engage the facing surface of the projection 39 of the corresponding connector 29.

Once a connector 30 has been connected to the two profiled sections 28 constituting the corresponding cross member 18, the wedge-shaped member 37 can be inserted in the corresponding seat 36 of a connector 29 to connect the cross member quickly to the upright member. As already indicated above, as a result of the engagement of the wedge-shaped member 37 in the seat 36, the elements are interlocked and, at the same time, a tensioning effect is achieved which tends to pull the cross member into the seat 36 in the connector 29. By virtue of these characteristics, the connectors 29 and 30 are locked firmly and stably in the sections 29 and the cross member and the upright member are firmly locked together. A structure thus formed with the use of a plurality of cross members and upright members connected at their corresponding junctions by the mutual engagement of the connectors 29, 30, is an intrinsically stable structure which does not need further reinforcing members. The matching slots 40, 37*c* can be engaged by safety pins 49 with cross-sections corresponding to that of the slots 40, 37*c* whereby the pins can be inserted through the slots and then locked by being rotated through 90°.

The ends of the profiled sections 28 adjacent the joints in the framework are closed by closure elements 50 of plastics material with recessed end surfaces 51 complementary to the surfaces of the sides of the profiled sections 28.

Figure 17:
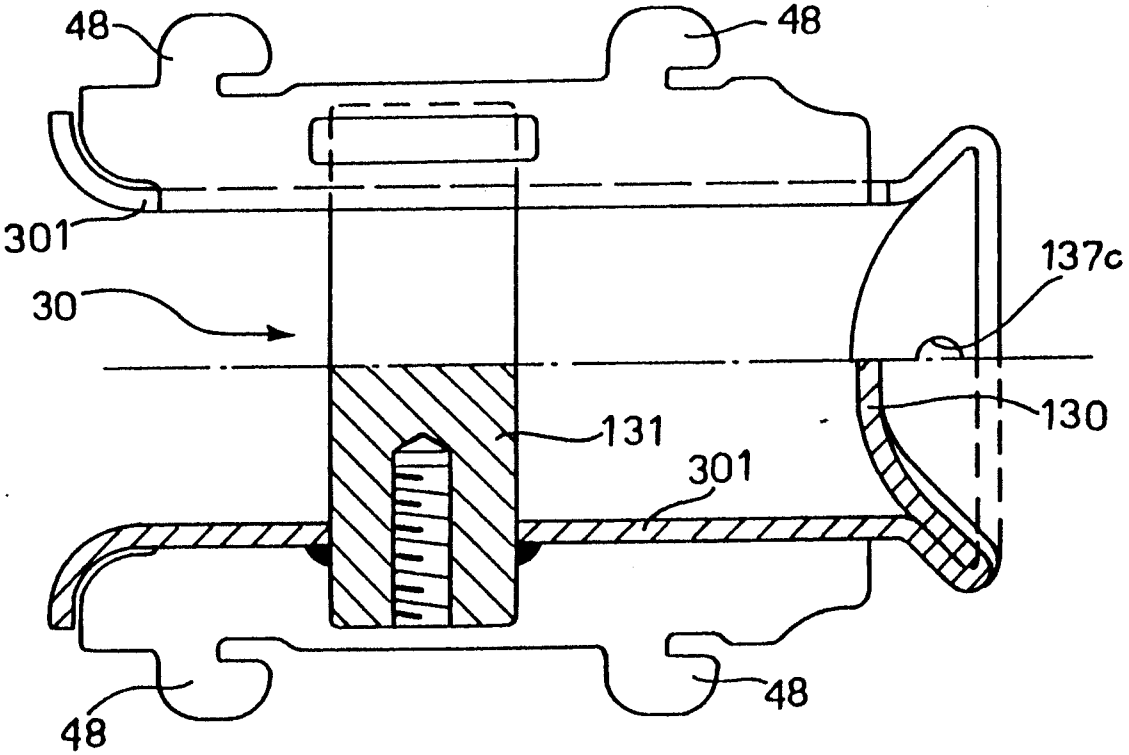
FIG. 17 shows a variant of a detail of FIG. 11, FIG. 18, is a front view of a connecting device forming part of the system of the invention.

FIG. 17 shows a variant of connector 30 in which the two longitudinal walls 301 of the connector are formed by a single U-bent sheet-metal strip 130 whose central section defines the wedge-shaped member 37, said walls being separated from each other at the end of connector 30 opposite the wedge-shaped member 37. Moreover, a strengthening cross-pin 131 is engaged within corresponding apertures of walls 301 and welded thereto. Finally slot 37*c* is replaced by a circular hole 137*c* for engagement of a screw, a corresponding threaded circular hole being provided in connector 29 in lieu of slot 40.

Figure 18:
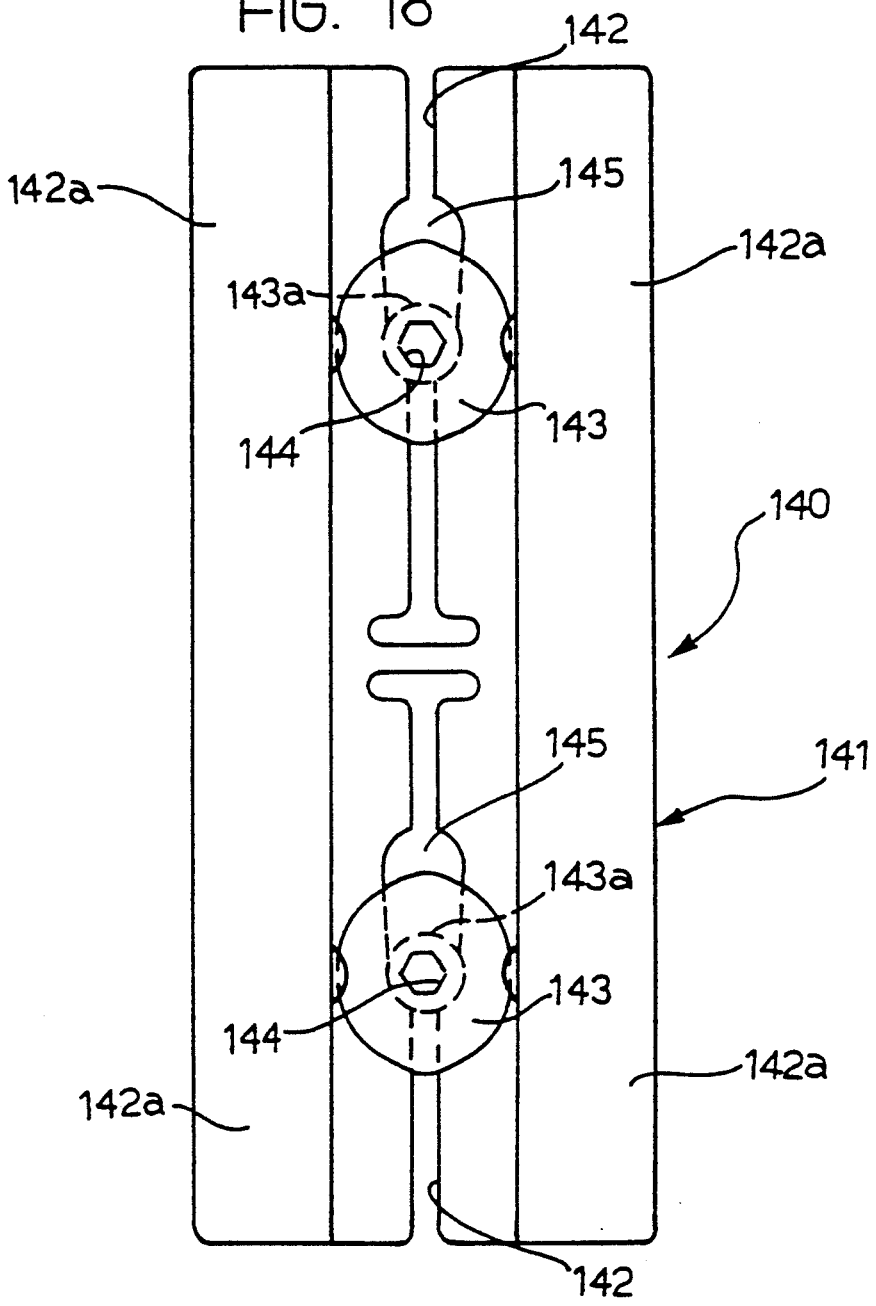
Figure 19:
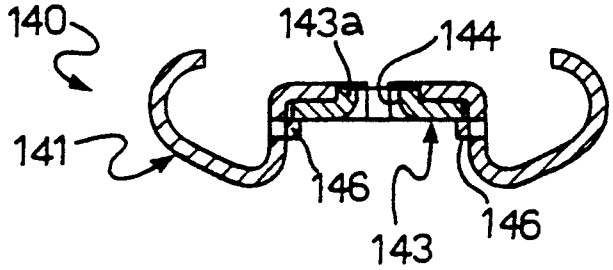
FIG. 19 is a cross-sectional view taken along line IX—IX of FIG. 18.

FIGS. 18, 19 show a connecting device 140 which can be used to connect the adjacent ends of the two aligned profiled sections 28. As shown in FIG. 19, the connecting device 140 is comprised of a profiled body 141 with a size and a shape making those of the inner surface of sections 28. The body 141 is for one half inserted within one end of a profiled section 28 and for the other half inserted within the adjacent end of the other section 8, whereupon body 141 is tightly fixed to section 28 to ensure connection of these sections. To this end, body 141 has two longitudinal slots 142 each extending from one end of body 141 through a length slightly lower than one half of the total longitudinal length of body 141. Each slot 142 defines two body wings 142*a* which can be elastically deflected to fix body 141 within the section 28 in which it has been inserted. Deflection of wings 142*a* is obtained by a cam disk 143 of sheet-metal, having a hub 143*a* which is rotatably supported within two facing semicircular portions formed by the walls of slot 142, each slot 142 having also an enlarged portion 145 to allow insertion of hub 143. Body 141 has two partially cut and deformed portion 146 to axially retain disk 143 in its seat. By rotating disk 143 for 90 degrees from the position shown in FIG. 18, deflection of wings 142*a* is obtained. The rotation of disk 143 is driven by a profile key (not shown) which can be inserted through a hole (not shown) of section 28 and corresponding profile hole 144 of disk 143.

Naturally, the principle of the invention remaining the same, the details of construction and forms of embodiment may be varied widely with respect to those described and illustrated by way of non-limiting example.

We claim:

1. An office furnishing unit comprising a framework including a plurality of cross members and upright members interconnected with each other, characterised in that each of the cross members and each of the upright members comprises two parallel, metal profiled sections, spaced apart and interconnected in at least two spaced-apart regions by first and second connectors, the first and second connectors associated with the upright members and with the cross members respectively having complementary mutual-engagement surfaces for interconnecting the cross members and the upright members quickly.

2. A furnishing unit according to claim 1, characterised in that each first connector associated with an upright member has two surfaces on opposite sides defining a seat which can receive corresponding wedge-shaped members associated with respective second connectors of two cross members, each first connector associated with the upright member also having, on two opposite sides, two vertical parallel rows of tabs which can be fitted into corresponding slots in facing surfaces of the two profiled sections constituting the upright member.

3. A furnishing unit according to claim 2, characterised in that each first connector associated with each upright member is comprised of two strips of pressed sheet-metal welded together and defining a generally H-shaped configuration whose end portions are turned outwardly and define the rows of tabs.

4. A furnishing unit according to claim 3, characterised in that each of the pressed sheet-metal strips has a central portion which is welded to the respective central portion of the other strip and two side portions which converge both vertically and horizontally to define a seat for a corresponding wedge-shaped member.

5. A furnishing unit according to claim 3, characterised in that each second connector associated with each cross member has a generally U-shaped body arranged in a horizontal plane in the assembled condition, with upper and lower flat projecting edge portions defining, on each side, two horizontal, vertically-spaced rows of tabs adapted to engage in corresponding slots in the two profiled sections constituting the cross member, the wedge-shaped member being constituted by an element which connects opposite ends of the U-shaped body and has a surface complementary to that of the seat formed in the corresponding first connector associated with each upright member.

6. A furnishing unit according to claim 1, characterised in that it comprises a connecting device for connecting adjacent ends of two aligned profiled sections, said connecting device having a profiled body which is adapted to be slidably mounted within the adjacent ends of the two aligned sections, said connecting device having a profiled body which is adapted to be slidably mounted within the adjacent ends of the two aligned sections, said body having at each end a longitudinal slot defining two wings and a cam disk rotatably supported within said slot and adapted to cause said wings to deflect elastically from each other.

* * * * *